US009631882B2

(12) United States Patent
Grant

(10) Patent No.: US 9,631,882 B2
(45) Date of Patent: Apr. 25, 2017

(54) METHOD AND DEVICE FOR IMPROVING COUNTERMASS-BASED RECOIL CONTROL IN PROJECTILE LAUNCHERS

(71) Applicant: Kevin Paul Grant, Slidell, LA (US)

(72) Inventor: Kevin Paul Grant, Slidell, LA (US)

( * ) Notice: Subject to any disclaimer, the term of this patent is extended or adjusted under 35 U.S.C. 154(b) by 688 days.

(21) Appl. No.: 14/059,002

(22) Filed: Oct. 21, 2013

(65) Prior Publication Data

US 2016/0223275 A1 Aug. 4, 2016

(51) Int. Cl.
*F41A 1/08* (2006.01)
*F41A 1/10* (2006.01)
*F41A 25/16* (2006.01)

(52) U.S. Cl.
CPC ..... *F41A 1/10* (2013.01); *F41A 25/16* (2013.01)

(58) Field of Classification Search
CPC ..... F41A 1/08; F41A 1/10
USPC ..... 89/1.701
See application file for complete search history.

(56) References Cited

U.S. PATENT DOCUMENTS 1,395,630 A * 11/1921 Davis ..... F41A 1/10 89/1.701
3,018,694 A * 1/1962 Browning ..... F41A 25/18 42/1.06
3,489,058 A * 1/1970 Andersson ..... F41A 1/08 102/444
3,899,954 A * 8/1975 Jayne ..... F41A 9/54 89/33.4
4,043,248 A * 8/1977 Bulman ..... F41A 1/08 89/1.703
4,088,057 A * 5/1978 Nasypany ..... F41C 23/06 42/1.06
4,244,293 A * 1/1981 Grosswendt ..... F41A 1/10 102/374
4,527,457 A * 7/1985 Fikse ..... F41B 6/006 124/3
5,491,917 A * 2/1996 Dilhan ..... F41A 1/08 42/1.06
5,551,330 A * 9/1996 Reuche ..... F41A 1/10 89/1.701

(Continued)

FOREIGN PATENT DOCUMENTS

GB 125605 5/1919
GB 125652 5/1919

(Continued)

*Primary Examiner* — Samir Abdosh
(74) *Attorney, Agent, or Firm* — Kenneth L. Tolar

(57) ABSTRACT

A recoil controller is disclosed whose body 1 incorporates a strategically designed inner surface or surfaces 2. A moving countermass 6 impacts one or more times against one or more inner surfaces 2. During this process momentum is transferred from the countermass 6, to the inner surfaces 2, and then to the body 1 of the recoil controller, and then to anything to which it is attached or against which it is braced. The distributions, over time, of the momenta resulting from this transfer of momentum will depend on various factors including the composition, geometry and placement of the inner surfaces 2. A given recoil controller is designed such that the distributions, over time, of the momenta resulting from its use, are preferable to the distributions, over time, of the original momenta. The countermass 6' shown in FIG. 1 is the countermass 6 shown after one impact.

46 Claims, 18 Drawing Sheets

(56) References Cited

U.S. PATENT DOCUMENTS

| | | | | |
|---|---|---|---|---|
| 6,354,035 | B1 * | 3/2002 | Niebuhr | F41A 9/60<br>42/98 |
| 6,578,464 | B2 * | 6/2003 | Ebersole, Jr. | F41A 25/06<br>42/1.06 |
| 7,302,773 | B2 * | 12/2007 | Rozhkov | F41A 3/54<br>42/2 |
| 7,398,614 | B2 * | 7/2008 | Rozhkov | F41A 3/56<br>42/2 |
| 7,418,896 | B1 * | 9/2008 | Dindl | F41A 1/10<br>102/437 |
| 8,322,264 | B1 * | 12/2012 | Van De Wal | F41A 1/08<br>102/437 |
| 2003/0056639 | A1 * | 3/2003 | Giza | F41A 3/54<br>89/1.701 |

FOREIGN PATENT DOCUMENTS

| | | |
|---|---|---|
| GB | 126336 | 5/1919 |
| WO | 2010051898 | 5/2010 |

* cited by examiner

1 – Bodies
(sample geometries)

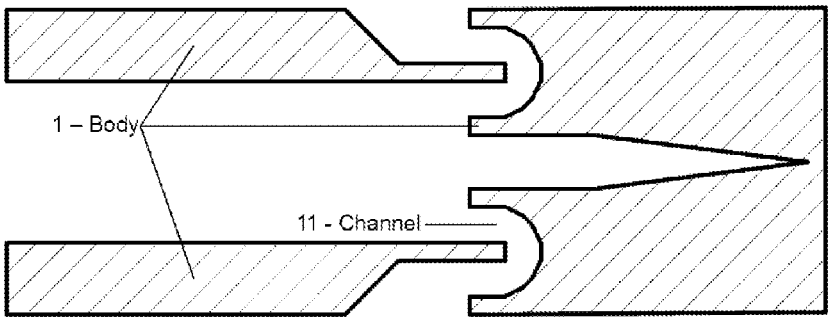
Fig. 6
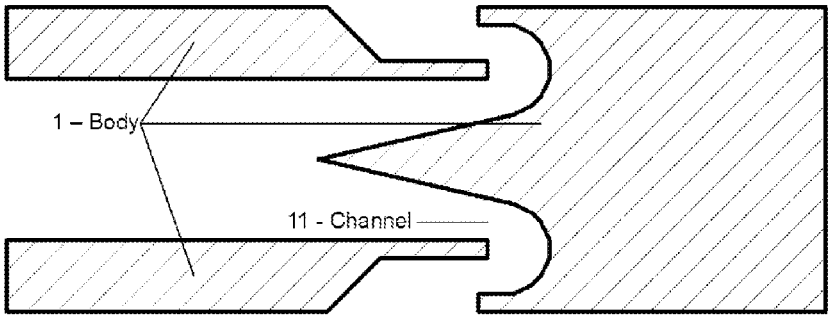

METHOD AND DEVICE FOR IMPROVING COUNTERMASS-BASED RECOIL CONTROL IN PROJECTILE LAUNCHERS

CROSS-REFERENCE TO RELATED APPLICATIONS

Not applicable.

STATEMENT REGARDING FEDERALLY SPONSORED RESEARCH OR DEVELOPMENT

Not applicable

REFERENCE TO A "MICROFICHE APPENDIX"

Not applicable

BACKGROUND OF THE INVENTION

1. Field of the Invention

The present invention relates to improving the performance of countermass-based mechanisms for recoil control in projectile launchers.

2. General Background of the Invention

In any projectile-firing device, Newton's third law requires that the recoil caused by the firing of the projectile exactly balances the momentum carried by the projectile and the exhaust gasses. Recoil resulting from the momentum of the exhaust gases is called "secondary recoil". Secondary recoil can be reduced to acceptable levels via the use of ports. Ports are holes in the forward end of the barrel of a projectile launcher that release the exhaust gasses radially just before the projectile exits the barrel. Since the gasses are released radially there is little net transfer of momentum to the body of the projectile launcher. Recoil resulting from the momentum of the projectile is called "primary recoil". There is no way to alter the total amount or direction of primary recoil without affecting the velocity or direction of the projectile, usually an undesirable outcome.

Uncompensated recoil causes both excessive wear and tear on the supporting mechanism (possibly a person) as well as a tendency to knock the projectile launcher out of alignment with the target. These undesirable effects are due more to the way in which the recoil is distributed over time than to the total amount or direction of the recoil. Thus, changing the way in which the recoil is distributed over time can be used to mitigate the undesirable effects without changing the total amount or direction of the recoil. This is usually accomplished by slowing the transfer of the recoil to the body of the projectile launcher or its supporting mechanism. This spreads the recoil experienced by the projectile launcher or its supporting mechanism across more time, reducing "peak recoil", which is the greatest amount of recoil experienced by the projectile launcher or its supporting mechanism at some moment in time during the process of launching a projectile. While peak recoil is usually blamed for the worst of the effects caused by recoil, it is possible that altering other aspects of the distribution of recoil over time may be of benefit in mitigating the undesirable effects of recoil. The present invention makes possible the adjustment of various aspects of the distribution of recoil over time including both peak recoil and aspects of recoil other than peak recoil.

There are two approaches to controlling primary recoil that have been in common use at various times:

1. Increase the mass of the projectile launcher. When the same amount of recoil must move a larger mass it can only accelerate it to a proportionally smaller velocity. Unfortunately this approach has the disadvantage of making the projectile launcher substantially heavier. This approach has two variants:
   a) Use a stationary weight. Using this method the effects of the recoil are lessened solely by the increased mass of the projectile launcher combined with the weight.
   b) Use a moving weight. Using this method the body of the projectile launcher moves faster than the weight, which catches up later. As it does, the momentum contained in the moving weight is transferred to the body of the projectile launcher. The time during which the weight is moving adds to the time that it takes the entirety of the recoil to be transferred to the body of the projectile launcher.
2. Upon firing, cause a countermass to move in such a fashion as to cancel out the primary recoil. This approach has the following two variants:
   a) Allow the countermass to continue traveling rearward until after it has left the projectile launcher. This approach has the disadvantage of creating an area of intense danger directly behind the projectile launcher, through which the ejected countermass travels.
   b) Do not allow the countermass to leave the projectile launcher. This approach has the following three variants:
      i. Use of deformable means. This method slows the transfer of momentum from the countermass to the body of the projectile launcher by requiring it to pass through a deformable mass at some point in the process. The time that it takes the mass to deform is added to the time that it takes for the momentum to be completely transferred to the body of the projectile launcher. Depending on the type of material used, the mass may or may not return to its original shape after use.
      ii. Use of friction. This method slows the transfer of momentum from the countermass to the body of the projectile launcher by requiring it to be transferred via friction between the moving countermass and the body of the projectile launcher.
      iii. Use of impact. This method delays the transfer of momentum from the countermass to the body of the projectile launcher until the countermass hits a stop.

The mechanism disclosed herein is of type 2b. Many mechanisms of this type have been tried. A representative sampling is discussed below, in chronological order.

In British patent number GB126336 the patentee discloses a mechanism whereby peak recoil can be reduced in a firearm. The mechanism is composed of two parts. First, a section of barrel, closed at the rearward end, extending behind the projectile and narrowing somewhat in diameter as it progresses rearward. Second, a cylindrical cup composed of brass (or another soft metal), with a diameter essentially the same as that of the rearward barrel, placed directly behind the propellant charge, with the opening oriented directly towards the projectile and the opening at the front of the barrel. Upon firing, the countermass (the cup) is propelled rearwards along the barrel. Friction between the cup and the inside surface of the barrel slows the cup as it travels rearward. The decreasing diameter of the barrel eventually forces the cup to a stop, at which point all of the rearward momentum has been transferred to the body of the gun. See also related British patents numbered GB125652 and GB125605, each with one additional author. In GB125652 the cup leaves the rearward barrel rather than being forced to a complete stop within the rearward barrel, and in GB125605 an inertial mass leaves the rear of the gun, and the transfer of momentum from the inertial mass to the gun is assisted by means of a very tight spiral of rifling in the portion of barrel along which the inertial mass travels.

There are several practical problems with this approach which render it unusable as a recoil reduction device. First, according to the disclosure the barrel and cup are necessarily of different metals, the cup being the softer, to avoid wear on the barrel. One side effect of this is that with each use metal would rub off of the cup and plate the inner surface of the barrel. Because of this each use would change the amount of friction between the barrel and successive cups, significantly altering the performance of the gun. Second, differences in the amount of expansion that different metals undergo at different temperatures would change the fit between the cup and the barrel. A gun manufactured in a temperate environment might not function properly in a desert or arctic setting. Even the heat generated by friction as the cup travels along the barrel might be enough to cause misfires or worse. This is particularly troublesome given that the successful operation of the mechanism is strongly dependent on having an exact fit between the cup and the barrel. Third, the mechanism is so dependent on having an exact fit between cup and barrel that the presence of small amounts of dust or dirt in the barrel could jam the cup long before it reached the end of the barrel, with unpredictable results.

In U.S. Pat. No. 3,018,694 the patentee discloses a mechanism whereby peak recoil can be reduced in a firearm. The mechanism is composed of a main, reciprocating barrel down which the bullet travels, connected to a piston housed inside of an auxiliary barrel located beneath the main barrel. Upon firing, the main barrel moves backwards towards the shooter, carrying the piston in the auxiliary barrel with it. Past a certain point, compressed air from behind the bullet is fed from the main barrel into the auxiliary barrel at a point between the piston and the shooter. The compressed air acts as a brake on the piston, and through it the main barrel, transferring momentum from the main barrel into the body of the firearm. Upon complete breaking of the piston the compressed air behind the piston, and a return spring, cause the piston and main barrel to return to their initial position. The primary advantage claimed by the patentee is that the mechanism does not have to be adjusted to compensate for different loads. Heavier loads will produce more gas pressure, providing the greater breaking necessary for the faster-moving piston without the need for adjustment by the shooter.

As with all of the piston-based approaches most of the problems are those related to the use of an unnecessarily complex mechanism. One problem is the unnecessarily high cost of construction, including the cost of the various machined components and their assembly into the final device. Other problems include the costs and efforts associated with cleaning, maintaining, durability, repair, and the necessity for the stockpiling of replacement parts. The fact that successful functioning requires that several parts move smoothly against each other in a controlled fashion makes the mechanism vulnerable to dirt, dust and sand. The fact that the same force that propels the bullet forwards also propels the reciprocating barrel backwards, and that some of the propellant gasses are bled from inside of the barrel before the bullet exits the barrel, robs the bullet of power. Finally, the mechanism is unnecessarily heavy, adding to the weight of the gun.

In U.S. Pat. No. 4,088,057 the patentee discloses a mechanism whereby peak recoil can be reduced in a firearm. The mechanism is composed of a closed auxiliary barrel, containing a weighted piston, mounted atop the main barrel. When the gun is fired some compressed air is bled from the main barrel into the auxiliary barrel, driving the piston rearwards. The rearward momentum is held by the piston until it approaches the rearward most portion of the auxiliary barrel. At this point air trapped between the piston and the rearward closed end of the auxiliary barrel causes the piston to slow, transferring momentum to the gun via the compressed air. Upon completion of this movement, the piston is returned to its original position by a spring.

The problems with this mechanism are basically the same as those of the piston-based device disclosed in U.S. Pat. No. 3,018,694, but somewhat reduced due to improvements in the overall design. Most noteworthy is that in this mechanism the main barrel does not reciprocate, removing one of two mechanisms responsible for decreasing the power of the bullet.

In U.S. Pat. No. 6,578,464 the patentee discloses a mechanism for reducing peak recoil. The mechanism is described in the context of an explosives disruptor, which device is used to set off an explosive device from a distance by firing a projectile into it. The mechanism consists of a two part barrel. The first part is an inner, sliding barrel, with a closed breech end, similar to that used in some conventional firearms today. The second part is an outer, non-moving barrel, enclosing the inner barrel and connected to the gun body. The inner barrel slides along the outer barrel upon firing. The outer surface of the inner barrel contains a widened area that is directly in contact with the inner surface of the outer barrel. As the inner barrel recoils, momentum is transferred to the gun body via the friction between the inner and outer barrels.

The problems with this approach are similar to those of the friction-based approach disclosed in British patent number GB126336 discussed above. Continued friction between the widened area of the inner barrel and the inner surface of the outer barrel creates heat, wearing of the parts that are in constant contact with each other, plating of the inner surface of the outer barrel with material from the widened part of the inner barrel, etc. The friction generated heat creates the same risk of differential expansion of different parts of the mechanism, and the potential negative consequences thereof, which were present in the device disclosed in British patent number GB126336. Finally, the use of a reciprocating barrel robs the projectile of power just as was the case with the device disclosed in U.S. Pat. No. 3,018,694.

In U.S. Pat. No. 7,302,773 the patentee discloses a device for delaying peak recoil that consists of a two part barrel, the rearmost section containing the cartridge and constructed so as to slide backward upon firing, continuing until it hits a stop. In this fashion the recoil is delayed from affecting the gun body until after the bullet has left the barrel, supposedly improving the accuracy of the weapon. This approach is problematic in two regards. First, it doesn't decrease peak recoil; it only delays peak recoil until the moving portion of the barrel hits the stop. Second, some of the power used to propel the bullet is diverted into moving the moving portion of the barrel, robbing the bullet of power.

In U.S. Pat. No. 7,398,614 the patentees (who are also the named inventors of U.S. Pat. No. 7,302,773, discussed above) disclose a mechanism for delaying peak recoil that consists of a barrel, anchored to the gun body, down which the bullet travels, a forward sliding mass surrounding the barrel, and a rearward sliding mass that butts up against the rear of the barrel and contains the cartridge. Upon firing the force of the expanding gasses within the barrel pushes the forward sliding mass forwards, and the rearward sliding mass rearwards, in such a fashion that the recoil that would normally be transmitted into the gun body is instead transferred into the two sliding masses. Eventually the sliding masses hit prepositioned stops anchored to the gun body, at which time they cease sliding and their momentum is transferred through the stops into the gun body. The problems with this mechanism are the same as those discussed with the simpler mechanism disclosed in U.S. Pat. No. 7,302,773.

In international patent number WO2010051898 the applicants disclose a mechanism for reducing peak recoil in a weapon that uses a backward sliding barrel with a closed breech end. The recoil reduction mechanism consists of a deformable mass situated between the breech of the barrel and the weapon mounting. Upon firing, the recoil is transferred first to the barrel, then through the backward sliding barrel into the deformable mass, causing it to deform, thus causing the recoil to be transferred to the weapon's mounting over a longer period of time, reducing peak recoil. The primary problem with the mechanism described in this patent is that it requires manual replacement of the deformed mass after use, as well as manual resetting of the positions of the various components of the weapon, including the barrel.

BRIEF SUMMARY OF THE INVENTION

There is a need for a recoil controlling device which overcomes the disadvantages associated with the representative recoil controlling mechanisms discussed above. Several advantages of one or more aspects of the present invention disclosed in this patent application are the provision of a method and device whereby a simpler, cheaper, lighter, more robust, durable, and easier to maintain mechanism for controlling recoil may be constructed.

The present invention functions by causing a moving countermass to impact one or more times against one or more surfaces. After the impacts the distributions, over time, of the momenta remaining in the countermass, in one or more of the surfaces, and in whatever the surfaces have been attached to or braced against, have been altered. The surfaces are shaped in such a fashion (and/or created with such other properties) that the distributions, over time, of the resulting momenta, are preferable to those of the unaltered momenta of the same members.

Upon firing a projectile launcher with a countermass-based mechanism for controlling recoil, a countermass is accelerated in the direction of the recoil. This counteracts the effect of primary recoil on the body of the projectile launcher. In one embodiment of the present invention, when the countermass impacts against the surfaces of the recoil controller, momentum is transferred from the countermass to the recoil controller and from the recoil controller to whatever the recoil controller is attached to or braced against, e.g., the body of the projectile launcher. Successive impacts continue the process. Depending on the exact properties of the surfaces of the recoil controller, and the way that the recoil controller is used in this application, the effect will be to change the distribution, over time, of the recoil experienced by the body of the projectile launcher.

BRIEF DESCRIPTION OF THE SEVERAL VIEWS OF THE DRAWINGS

For a further understanding of the nature, objects, and advantages of the present invention, reference should be had to the following detailed description, read in conjunction with the following drawings, wherein like reference numerals denote like elements and wherein:

FIG. 6 is a partial cutaway view of two embodiments of the apparatus of the present invention showing two alternate geometries;

DETAILED DESCRIPTION OF THE INVENTION

Figure 1:
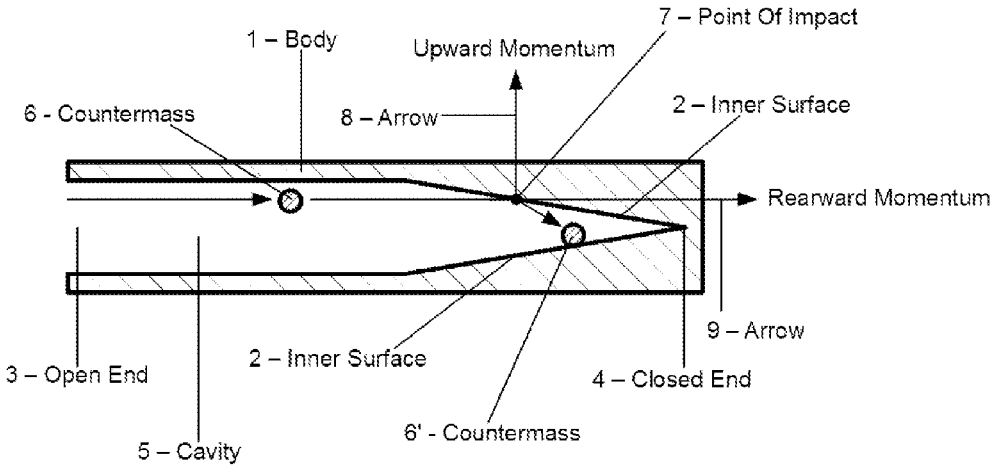
FIG. 1 is a partial cutaway view of the preferred embodiment of the apparatus of the present invention.
Figure 9:
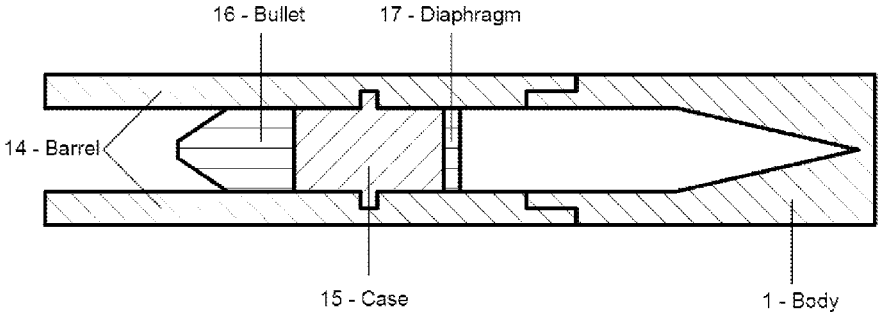
FIG. 9 is a partial cutaway view of an embodiment of the apparatus of the present invention configured as a separate unit attached to the barrel of a projectile launcher.
Figure 10:
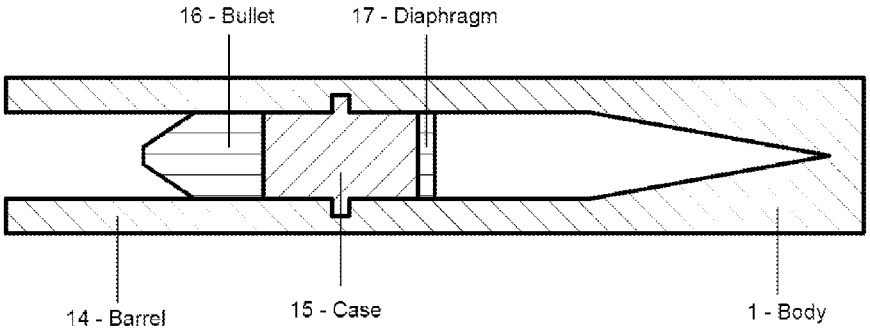
FIG. 10 is a partial cutaway view of an embodiment of the apparatus of the present invention configured as an integral part of the barrel of a projectile launcher.
Figure 11:
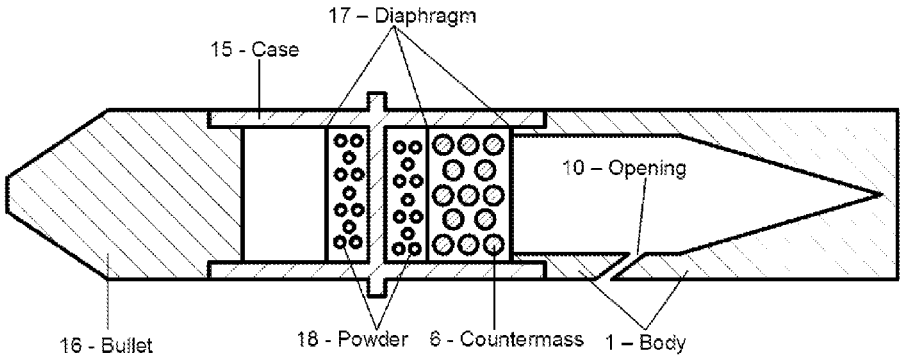
FIG. 11 is a partial cutaway view of an embodiment of the apparatus of the present invention configured as a separate unit attached to the case of a projectile to be fired by a projectile launcher.

FIG. 1 shows the preferred embodiment of the apparatus of the present invention. In FIG. 1, the recoil controller is shown just after the countermass 6 has entered the body 1. The countermass 6 enters the body 1 at the open end 3 and continues to move through the cavity 5 towards the closed end 4. Eventually the countermass 6 will impact against the inner surfaces 2 of the body 1 at the point of impact 7 imparting some or all of its momentum to the body 1. The amount and direction of the momentum imparted by the mechanism described in this and other embodiments will depend on one or more members of a set of factors, a subset of which consists of the following:

1. the composition of the inner surfaces 2 of the body 1;
2. the geometry of the inner surfaces 2 of the body 1;
3. the composition of the body 1 in whole or in part;
4. the geometry of the body 1 in whole or in part;
5. variations in the mass, charge, temperature, magnetic field strength and/or other properties of the body 1 in whole or in part;
6. the configuration of the body 1 in relation to its application. Three examples of the many configurations possible are that:
   a) the body 1 may be a separate unit connected to another mechanism (such as the barrel of projectile launcher) as shown in FIG. 9, or
   b) the body 1 may be an integral part of another mechanism (such as the barrel of a projectile launcher) as shown in FIG. 10, or
   c) the body 1 may be connected to or integral to one mechanism (such as a projectile) that is used in association with another mechanism (such as a projectile launcher) as shown in FIG. 11.

Configurations may differ from each other in ways other than the nature of the connection between the body 1 and another mechanism;

7. the values of parameters describing properties of the countermass 6; and
8. the values of parameters describing properties of the movement of the countermass 6.

The countermass 6' shown in FIG. 1 is the countermass 6 at a point in time after its initial impact at 7 against the inner surfaces 2 of the body 1. The two arrows 8, 9 labeled "upward momentum" and "rearward momentum" represent the upward and rearward components, respectively, of the momentum transferred from the countermass 6 to the body 1 at the point of impact 7. Successive impacts between the countermass 6 and the inner surfaces 2 of the body 1 transfer additional momentum between the countermass 6 and the body 1. The embodiment shown in FIG. 1 functions in such a fashion that the net transfer of momentum is from the countermass 6 to the body 1. However, as with all embodiments, there are circumstances under which it may be the case that the net transfer of momentum is in the opposite direction. The body 1 and its inner surfaces 2 are designed so that the distribution, over time, of the momenta resulting from the transfer of momentum between the countermass 6 and the body 1, are preferable to those of the unaltered momenta.

The embodiment shown in FIG. 1 comprises a cylinder with a bore starting at one end and continuing almost all of the way to the other. The radius of the bore may or may not be constant along its entire length. According to the embodiment shown in FIG. 1 the bore is of constant radius along approximately the first half of its length, and of linearly decreasing radius along the remainder of its length. The cylinder of the embodiment shown in FIG. 1 can have a circular cross section. However, as with all embodiments, it can have different cross sections, such as oval, triangular, rectangular, etc., and different sizes and materials, such as high-carbon steel, titanium, polycarbonate, etc., and the shape, size and material and other properties can differ at different points throughout the device. The bore of the embodiment shown in FIG. 1 can have a circular cross section. However, as with all embodiments, it can have different cross sections, such as oval, triangular, rectangular, etc., and different sizes, both of which can differ throughout the device.

For reasons of convenience the countermass 6 shown in FIG. 1 is contemplated as consisting of two pieces of a larger countermass comprised of many small pieces of matter, such as the shot typically comprising the contents of a shotgun shell. In practice, any embodiment of the recoil controller may be configured to work with countermasses of any of a large variety of compositions and properties, including but not limited to countermasses that are:

1. composed of one or more pieces;
2. possessed of various values for a list of properties including but not limited to mass, volume, shape, temperature, charge and magnetic field strength;
3. composed of any element, or combination of elements, in any form, including but not limited to atomic and molecular;
4. composed of some combination of one or more phases of matter including, but not limited to:
   a) the so-called "classical" phases of matter: solid, liquid, and gas;
   b) unusual varieties of one or more of the classical phases, including but not limited to non-Newtonian fluids; and
   c) non-classical phases of matter, including but not limited to plasmas, glasses, plastic crystals, liquid crystals, and superfluids.
5. composed of a shock-wave or pressure-wave comprised of compressed, or rarefied, or mixed compressed and rarefied regions of any phase or phases of matter.

Or varying in one or more of a number of other aspects including, but not limited to: physical, chemical, electrical, thermal, magnetic, and/or isotopic.

Also for reasons of convenience, the cavity 5 shown in FIG. 1 is contemplated as containing an environment consisting essentially of air. In practice, any embodiment of the recoil controller may be configured to work with cavities containing a number of other environments, including but not limited to:

1. vacuum;
2. an environment composed of some combination of one or more phases of matter including, but not limited to:
   a) the so-called "classical" phases of matter: solid, liquid, and gas;
   b) unusual varieties of one or more of the classical phases, including but not limited to non-Newtonian fluids; and
   c) non-classical phases of matter, including but not limited to plasmas, glasses, plastic crystals, liquid crystals, and superfluids.

Among the advantages of this approach are:

1. Simplicity: The recoil controller as described can be embodied in the form of a single piece of shaped material. This is a substantially simpler device than any of the existing countermass-based devices for recoil control.

2. Economy: A single piece of shaped material is likely to be significantly cheaper to manufacture than a more complex device such as some of those discussed in the Prior Art section of this application.
3. Weight: Depending on the choice of material, a recoil controller of the type disclosed in this application could be constructed in a very lightweight form.
4. Robustness: A single piece of shaped material will be more robust than a more complicated device. For example, a recoil controller consisting of a single piece of material with no moving parts can be expected to be largely unaffected by such issues as the presence of small amounts of wear and/or dirt.
5. Durability: A recoil controller consisting of a single piece of shaped material can be expected to be more durable than, for example, a recoil controller containing a piston, multiple seals, springs, etc.
6. Maintenance: A recoil controller consisting of a single piece of shaped material can be expected to be easier to maintain than many of the existing countermass-based mechanisms for recoil control. For example, it is reasonable to expect that what cleaning is necessary would consist of little more than submerging the recoil controller in a cleaning solution for a short period of time.

Many of the advantages of the recoil controller disclosed in this patent application are a consequence of the fact that in many embodiments the primary mode of transfer of momentum between the countermass and the recoil controller is via successive impacts between the countermass and the surfaces designed into the recoil controller. Additional benefit may be gained from the existence of friction and/or other contact forces between the countermass and the recoil controller. Various advantages of one or more aspects of the recoil controller will become apparent from a consideration of the ensuing descriptions and accompanying drawings.

Figure 2:
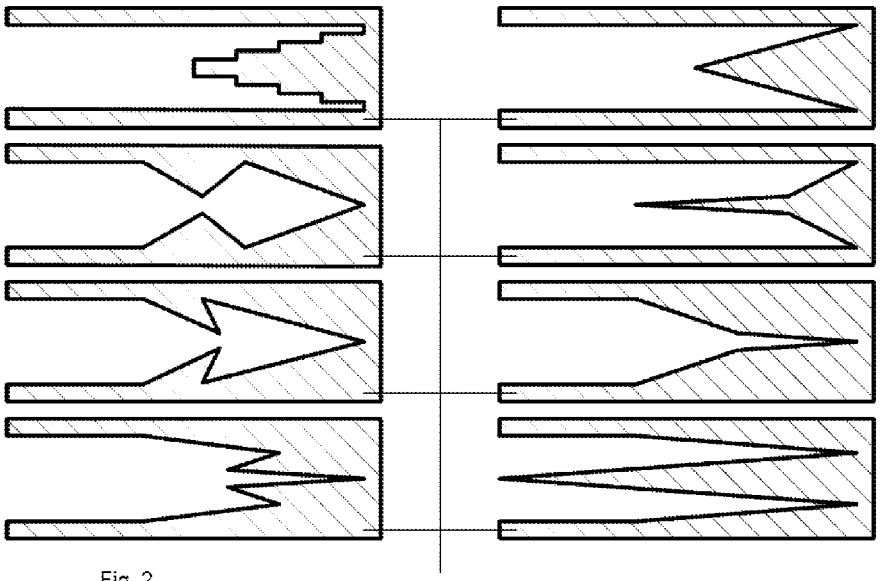
FIG. 2 is a partial cutaway view of several embodiments of the apparatus of the present invention showing several alternate geometries.

FIG. 2 shows cutaway views of additional embodiments of the recoil controller with differing geometries of the inner surface or surfaces. The figures are not drawn to scale. Differing geometries will have differing effects on the distribution, over time, of the momenta resulting from the transfer of momentum between the countermass and the inner surfaces of the body 1.

The embodiments of FIG. 2 should not be construed as limitations on the scope of the geometries with which the inner surfaces of the recoil controller can be configured, but rather as exemplifications of several embodiments thereof. Many other variations are possible. I presently contemplate that a recoil controller whose inner surfaces exhibit any geometry, no matter how regular or irregular, such that the post-transfer distributions over time of the momenta of the members involved in the process are different from the pre-transfer distributions over time of the momenta of the members involved in the process, comprises an embodiment of the recoil controller.

Figure 3:
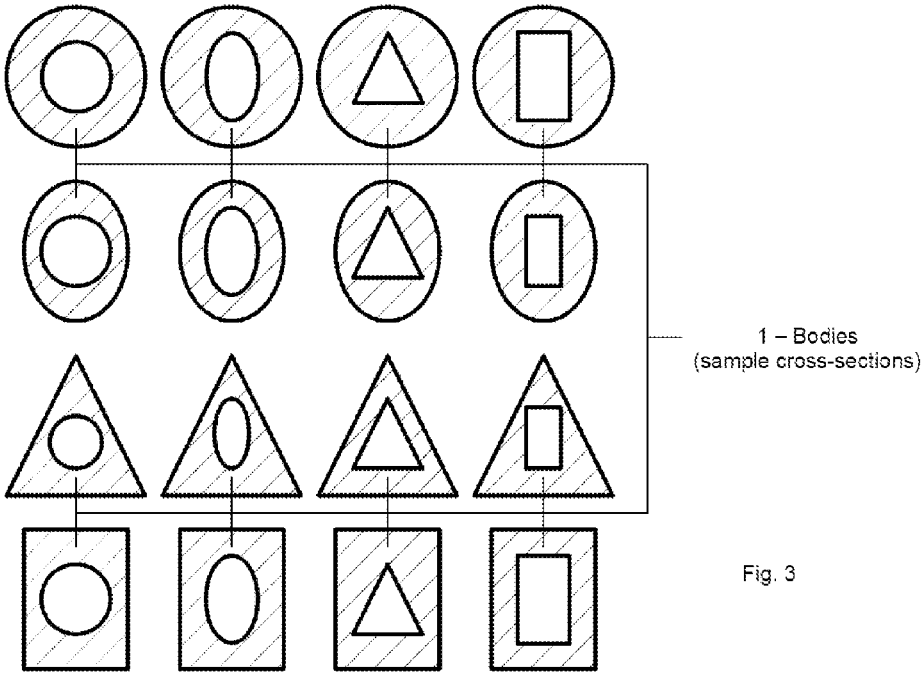
FIG. 3 is a cross-sectional view of several embodiments of the apparatus of the present invention showing several alternate geometries.

FIG. 3 shows cross-sectional views of additional embodiments of the recoil controller with differing geometries of the inner and outer surface or surfaces. The figures are not drawn to scale. Differing geometries will have differing effects on the distribution, over time, of the momenta resulting from the transfer of momentum between the countermass and the inner surfaces of the body 1.

The embodiments of FIG. 3 should not be construed as limitations on the scope of the geometries with which the inner and outer surfaces of the recoil controller can be configured, but rather as exemplifications of several embodiments thereof. Many other variations are possible. I presently contemplate that a recoil controller whose inner and outer surfaces exhibit any geometry, no matter how regular or irregular, such that the post-transfer distributions over time of the momenta of the members involved in the process are different from the pre-transfer distributions over time of the momenta of the members involved in the process, comprises an embodiment of the recoil controller.

Figure 4:
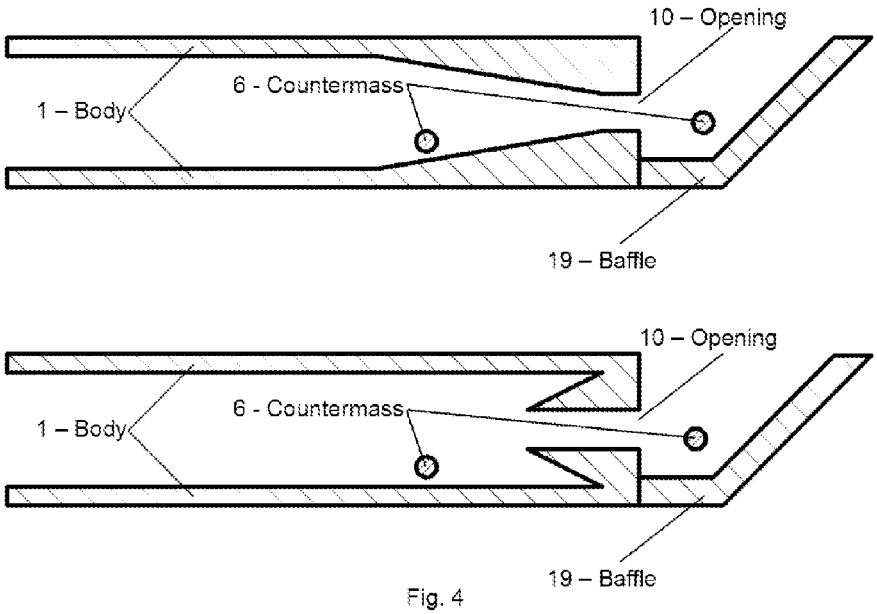
FIG. 4 is a partial cutaway view of two embodiments of the apparatus of the present invention showing two alternate geometries.

FIG. 4 shows two embodiments of the recoil controller similar to the embodiment shown in FIG. 1, except that the geometry of the inner surfaces is different (as in FIG. 2), and the closed end of the body 1 shown in FIG. 1 is partially open. Also shown is a protective baffle 19 to prevent the user from coming into contact with dangerous parts of the device or nearby spaces during operation. The figures are not drawn to scale. The embodiments of FIG. 4 should not be construed as limitations on the scope of the open-ended or baffle-comprising geometries with which the recoil controller can be configured, but rather as exemplifications of several embodiments thereof. Many other variations are possible. I presently contemplate that a recoil controller exhibiting any partially or completely open-ended geometry, no matter how regular or irregular, or any baffle-comprising configuration, such that the post-transfer distributions over time of the momenta of the members involved in the process are different from the pre-transfer distributions over time of the momenta of the members involved in the process, comprises an embodiment of the recoil controller.

The embodiments shown in FIG. 4 operate in essentially the same fashion as the embodiment shown in FIG. 1 except for the differences in geometry, the presence of the additional opening or openings 10, and the presence of the baffles 19.

Figure 5:
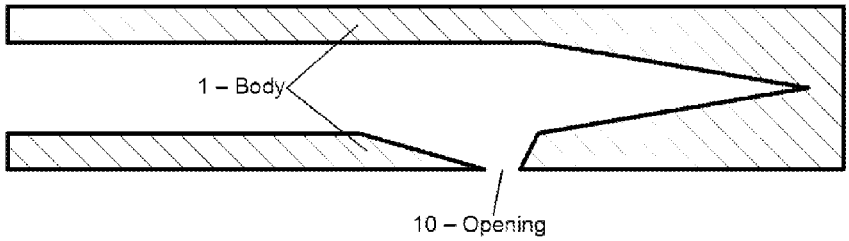
FIG. 5 is a partial cutaway view of an embodiment of the apparatus of the present invention showing an alternate geometry.

FIG. 5 shows an embodiment of the recoil controller similar to the embodiment shown in FIG. 1 except that the embodiment shown in FIG. 5 has an opening 10 along its length. The figure is not drawn to scale. Acceptable variations include embodiments that are similar to the embodiment of FIG. 5 except that there may be one or more openings that may differ in shape, size, position or other properties from each other and/or from the shape, size, position or other properties shown in FIG. 5.

The embodiment shown in FIG. 5 operates in essentially the same fashion as the embodiment shown in FIG. 1 except for the differences in geometry and the presence of the opening or openings.

FIG. 6 shows two embodiments of the recoil controller similar to the embodiment shown in FIG. 1, except that the geometry of the inner surfaces is different (as in FIG. 2), and the bodies of the recoil controllers in FIG. 6 contain channels 11 through which the countermass, or other substances such as expanding gasses, can be directed before exiting the recoil controller, possibly after a change in direction. The figures are not drawn to scale.

The embodiments of FIG. 6 should not be construed as limitations on the scope of the channel-containing geometries with which the recoil controller can be configured, but rather as exemplifications of several embodiments thereof. Many other variations are possible. I presently contemplate that a recoil controller and its inner surfaces containing any combination of geometries, no matter how regular or irregular, and channels 11, such that the post-transfer distributions over time of the momenta of the members involved in the process are different from the pre-transfer distributions over time of the momenta of the members involved in the process, comprises an embodiment of the recoil controller. Acceptable variations include embodiments that are similar to the embodiments of FIG. 6 except that the channels 11 may redirect the countermass, or other substances, back into another part of the recoil controller, or into another device, rather than allowing it to exit the recoil controller into the environment.

The embodiments shown in FIG. 6 operate in essentially the same fashion as the embodiment shown in FIG. 1 except for the differences in geometry and the presence of the channels 11.

Figure 7:
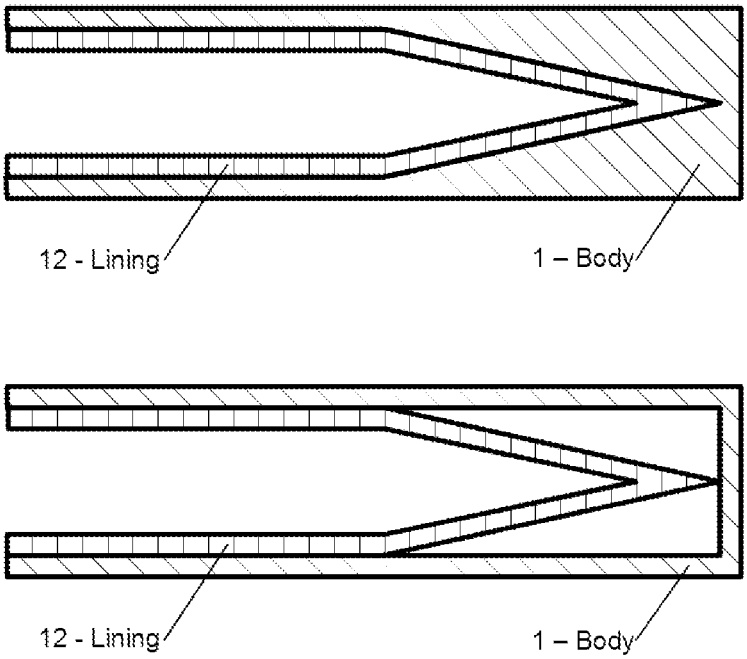
FIG. 7 is a partial cutaway view of two embodiments of the apparatus of the present invention showing two alternate configurations.

FIG. 7 shows two embodiments of the recoil controller similar to the embodiment shown in FIG. 1 except that the embodiments shown in FIG. 7 have an internal lining 12. The figures are not drawn to scale. The internal lining 12 may be included for any one of a number of purposes including, but not limited to, preventing wear on the inner surfaces of the recoil controller, changing the composition or other properties of the inner surfaces of the recoil controller, or changing the geometry of the inner surfaces of the recoil controller.

The embodiments shown in FIG. 7 operate in essentially the same fashion as the embodiment shown in FIG. 1.

Figure 8:
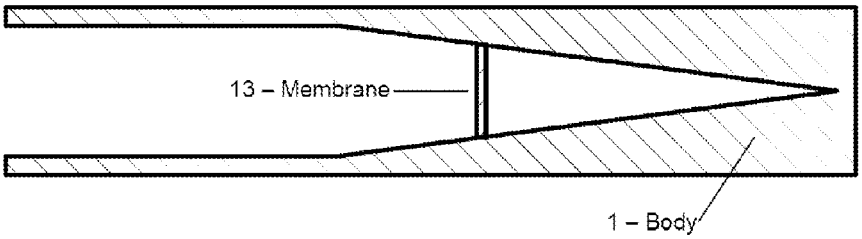
FIG. 8 is a partial cutaway view of an embodiment of the apparatus of the present invention containing a membrane.

FIG. 8 shows an embodiment of the recoil controller similar to the embodiment shown in FIG. 1, except that the internal geometry includes a membrane 13. The figure is not drawn to scale. The membrane 13 is a surface through which the countermass is intended and/or expected to pass, leaving a new opening in the membrane 13 in its wake, and/or altering, damaging, or destroying the membrane 13, in whole or in part, during its passage. During its passage through the membrane 13 some or all of its momentum may be transferred to the membrane 13 or to other inner surfaces or to the body of the recoil controller via the membrane 13, which may itself be designed so as to affect the transfer of momentum, as described elsewhere in this application. That is, the geometry, composition, position, and various other properties of the membrane 13 may be integral to the effect that its use has on the momenta of the countermass, the body 1 of the recoil controller, and its various members. Acceptable variations include embodiments that are similar to the embodiment of FIG. 8 except that there may be more than one membrane present, possibly with differences in various properties, including but not limited to shape, position, orientation, and composition.

The embodiment shown in FIG. 8 operates in essentially the same fashion as the embodiment shown in FIG. 1 except for the effect of the inclusion of a membrane 13.

FIG. 9 shows an embodiment of the recoil controller similar to the embodiment shown in FIG. 1, except that it is attached to the barrel 14 of a projectile launcher. The figure is not drawn to scale. The ammunition shown in the projectile launcher is assumed to be similar in function to the double-sided bullet presented in U.S. Pat. No. 7,418,896 in that when the bullet 16 is ejected from the front end of the case 15 a countermass (not shown) is ejected from the rear end of the case 15, from where it proceeds into the body 1 of the recoil controller. For purposes of simplification, an opening to allow for the escape of expanding gasses is not shown.

The embodiment of FIG. 9 should not be construed as a limitation on the scope of the configurations by which the recoil controller can be incorporated, by attachment, into a system comprising a recoil controller and a projectile launcher, but rather as an exemplification of a single embodiment thereof. Many other configurations are possible. I presently contemplate that any system whose configuration comprises a recoil controller and a projectile launcher such that the post-transfer distributions over time of the momenta of the members involved in the process are different from the pre-transfer distributions over time of the momenta of the members involved in the process, comprises an embodiment of such a system. Acceptable variations include, but are not limited to, those in which a recoil controller is attached to a projectile launcher by means of screw threading, glue, or friction; differences in the number, position and/or orientation of the recoil controllers; or the interposition of spacers, washers, or springs between the projectile launcher and the recoil controller.

The embodiment shown in FIG. 9 operates in essentially the same fashion as the embodiment shown in FIG. 1 except for its attachment to the barrel of a projectile launcher.

FIG. 10 shows an embodiment of the recoil controller similar to the embodiment shown in FIG. 1, except that it is an integral part of the barrel 14 of a projectile launcher. The figure is not drawn to scale. The ammunition shown in the projectile launcher is assumed to be similar in function to the double-sided bullet presented in U.S. Pat. No. 7,418,896 in that when the bullet 16 is ejected from the front end of the case 15 a countermass (not shown) is ejected from the rear end of the case 15, from where it proceeds into the body 1 of the recoil controller. For purposes of simplification, an opening to allow for the escape of expanding gasses is not shown.

The embodiment of FIG. 10 should not be construed as a limitation on the scope of the configurations by which the recoil controller can be incorporated, by integration, into a system comprising a recoil controller and a projectile launcher, but rather as an exemplification of a single embodiment thereof. Many other configurations are possible. I presently contemplate that any system whose configuration comprises an integrated recoil controller and a projectile launcher, such that the post-transfer distributions over time of the momenta of the members involved in the process are different from the pre-transfer distributions over time of the momenta of the members involved in the process, comprises an embodiment of such a system. Acceptable variations include, but are not limited to, differences in the number, position and/or orientation of the recoil controllers.

The embodiment shown in FIG. 10 operates in essentially the same fashion as the embodiment shown in FIG. 1 except for its integration into the barrel of a projectile launcher.

FIG. 11 shows an embodiment of the recoil controller similar to the embodiment shown in FIG. 1, except that it is attached to one end of the case of a projectile to be launched by a projectile launcher. The figure is not drawn to scale. The projectile shown in FIG. 11 is similar in function to the double-sided bullet presented in U.S. Pat. No. 7,418,896 in that when the bullet 16 is ejected from the front end of the case 15 the countermass 6 is ejected from the rear end of the case 15, from where it proceeds into the body 1 of the recoil controller. An opening 10 for the escape of expanding gasses is shown. For purposes of simplification the firing mechanism for the projectile is not shown, however a representative firing mechanism for a double-sided bullet may be found in U.S. Pat. No. 7,418,896. It should be noted that while both the bullet and the body of the recoil controller are connected to the case via friction, in this embodiment only the bullet is meant to detach from the case during the course of normal use.

The embodiment of FIG. 11 should not be construed as a limitation on the scope of the configurations by which the recoil controller can be incorporated into a system comprising a recoil controller and a projectile, but rather as an exemplification of a single embodiment thereof. Many other configurations are possible. I presently contemplate that any system whose configuration comprises a recoil controller and a projectile, such that the post-transfer distributions over time of the momenta of the members involved in the process are different from the pre-transfer distributions over time of the momenta of the members involved in the process, comprises an embodiment of such a system. Acceptable variations include, but are not limited to, attachment of the recoil controller to the projectile via screw threading, glue, or friction; differences in the number, position and/or orientation of the recoil controllers; the interposition of spacers, washers, or springs between the projectile and the recoil controller; the integration of the recoil controller directly into the case of the projectile; or the attachment or integration of the recoil controller into another device, other than a projectile, included as part of the system.

The embodiment shown in FIG. 11 operates in essentially the same fashion as the embodiment shown in FIG. 1 except for its attachment to the case of a projectile.

Figure 12:
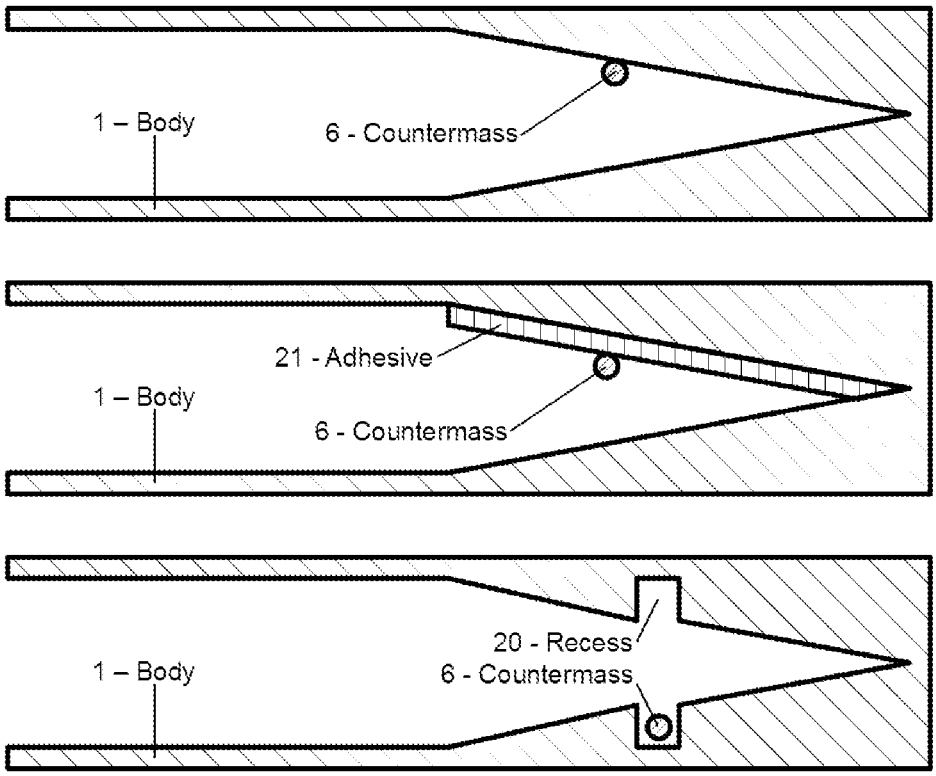
FIG. 12 is a partial cutaway view of three embodiments of the apparatus of the present invention showing three alternate configurations.

FIG. 12 shows three embodiments of the recoil controller similar to the embodiment shown in FIG. 1, except that each of the three embodiments comprises at least one inner surface that comprises one of the following three alternatives:

1. either a magnetic field or an electrical charge
2. adhesive 21
3. recesses 20 onto which the countermass can become attached, or into which the countermass can become lodged, during the course of normal operations. The figures are not drawn to scale. The embodiments of FIG. 12 should not be construed as limitations on the scope of the countermass-capturing configurations with which the inner surfaces of the recoil controller can be configured, but rather as exemplifications of several embodiments thereof. Many other variations are possible. I presently contemplate that a recoil controller and its inner surfaces exhibiting any configuration that allows for capture of the countermass, such that the post-transfer distributions over time of the momenta of the members involved in the process are different from the pre-transfer distributions over time of the momenta of the members involved in the process, comprises an embodiment of the recoil controller.

The embodiments shown in FIG. 12 operate in essentially the same fashion as the embodiment shown in FIG. 1 except for the differences in the configuration of the inner surfaces.

Figure 13:
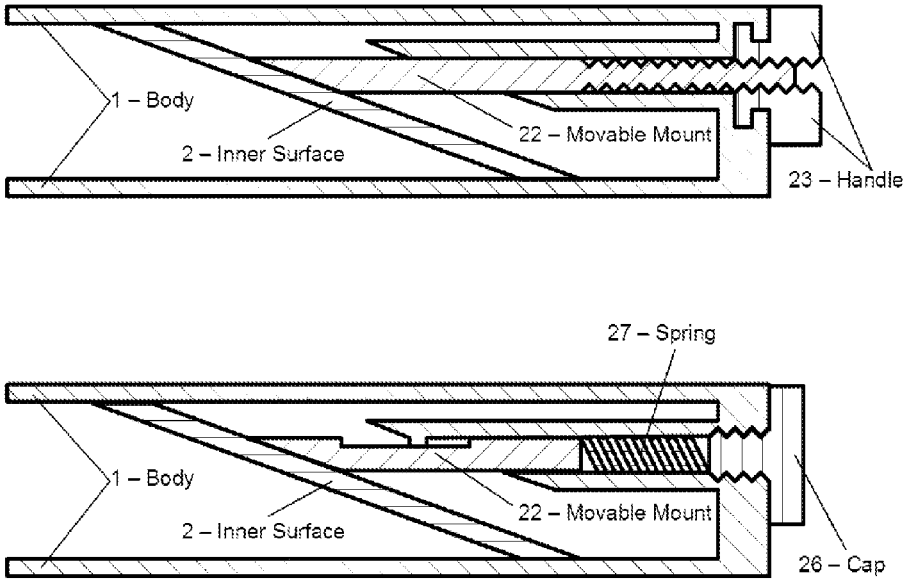
FIG. 13 is a partial cutaway view of two embodiments of the apparatus of the present invention showing two alternate configurations.

FIG. 13 shows two embodiments of the recoil controller similar to the embodiment shown in FIG. 1, except that each of the two embodiments comprises at least one inner surface 2 that is mounted upon a movable mount 22. For reasons of simplification the mechanism by which the inner surfaces 2 of the two embodiments are attached to the movable mounts 22 are not shown, but one mechanism by which this might be achieved is glue. The movable mount in the first embodiment shown in FIG. 13 is movable by means of turning a handle 23 whose rotation moves the inner surface 2 by means of screw threading built into the movable mount 22. Turning the handle repeatedly would eventually move the movably mounted surface 2 to the point where it could be removed from the recoil controller and replaced with a different, similarly mounted surface. Connecting this mechanism to a device for turning the handle 23 automatically would allow for the possibility of adjusting the position of the inner surface 2 automatically by means of another device. The movable mount 22 in the second embodiment shown in FIG. 13 is movable by means of a spring 27 built into the movable mount 22 and could be expected to move unassisted during the course of normal operation. The figures are not drawn to scale. The embodiments of FIG. 13 should not be construed as limitations on the scope of the configurations with manually or automatically adjustable movable surfaces, or surfaces that move during the course of normal operations, with which the recoil controller can be configured, but rather as exemplifications of two embodiments thereof. Many other variations are possible. I presently contemplate that a recoil controller exhibiting any configuration that allows for movable or replaceable surfaces, such that the post-transfer distributions over time of the momenta of the members involved in the process are different from the pre-transfer distributions over time of the momenta of the members involved in the process, comprises an embodiment of the recoil controller.

The embodiments shown in FIG. 13 operate in essentially the same fashion as the embodiment shown in FIG. 1 except for the differences in the configuration of the inner surfaces.

Figure 14:
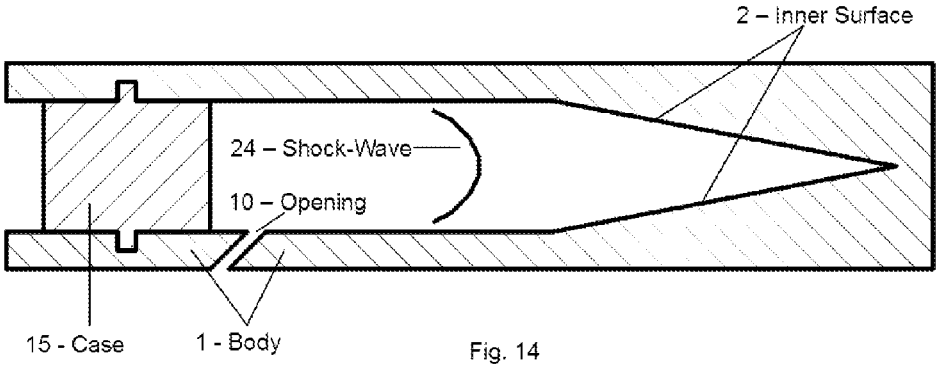
FIG. 14 is a partial cutaway view of an embodiment of the apparatus of the present invention showing an alternate configuration.

FIG. 14 shows an embodiment of the recoil controller similar to the embodiment shown in FIG. 1, except that it comprises a double-sided shell casing 15 and a small opening 10 to allow for the escape of excess gas pressure. In this embodiment the countermass is comprised essentially of the atoms or molecules of one or more gasses (possibly air) within and directly around the case 15. Other substances, including but not limited to gun powder residue and the remnants of a diaphragm that was part of the case 15, may also be present. The movement of the countermass manifests as a shock-wave (sometimes called a "pressure-wave") 24 travelling through the gas inside of the recoil controller. The movement of the countermass may also be described as areas of compression or rarefaction of a medium that move through the medium. The force of the shock-wave 24 is recaptured when it impacts against the inner surfaces 2 of the recoil controller. The figure is not drawn to scale. The embodiment of FIG. 14 should not be construed as a limitation on the scope of the configurations which cause the movement of the countermass to manifest as shock-waves, but rather as an exemplification of one embodiment thereof. Many other variations are possible including, but not limited to:

1. countermasses simultaneously comprising multiple, heterogeneous substances such as atoms or molecules of a gas or gasses, and larger masses such as those comprising the shot present in a typical shotgun shell;
2. shock waves travelling through types of media other than gasses.

I presently contemplate that a recoil controller exhibiting any configuration such that shock-waves are used to carry some or all of the force that is being used to control recoil, such that the post-transfer distributions over time of the momenta of the members involved in the process are different from the pre-transfer distributions over time of the momenta of the members involved in the process, comprises an embodiment of the recoil controller.

The embodiment shown in FIG. 14 operates in essentially the same fashion as the embodiment shown in FIG. 1 except for the differences in the configuration of the countermass as a collection of atoms or molecules of one or more gasses comprising a shock-wave.

Figure 15:
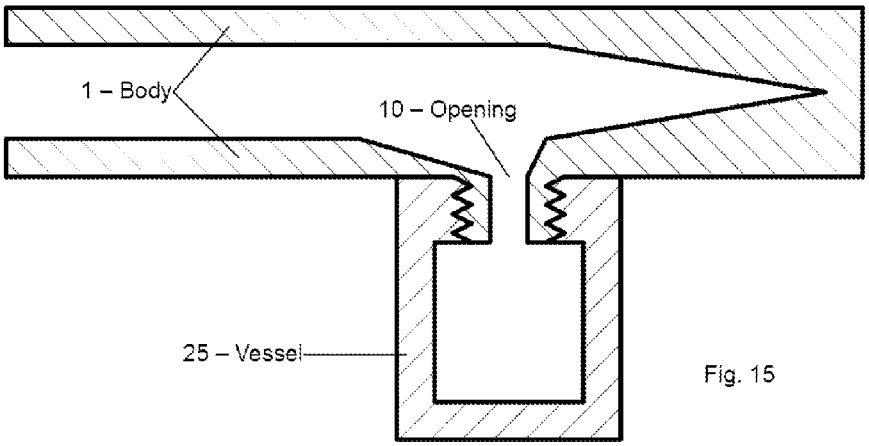
FIG. 15 is a partial cutaway view of an embodiment of the apparatus of the present invention showing an alternate configuration.

FIG. 15 shows an embodiment of the recoil controller similar to the embodiment shown in FIG. 1, except that it comprises a small opening 10 to allow for material to exit the body 1 of the recoil controller after use, and a vessel 25 for capturing said material as it exits, shown here attached to the body 1 of the recoil controller via screw threading.

The embodiment shown in FIG. 15 operates in essentially the same fashion as the embodiment shown in FIG. 1 except for the presence of the opening 10, that allows for material to exit, and the vessel 25 which allows for exiting material to be captured.

Figure 16:
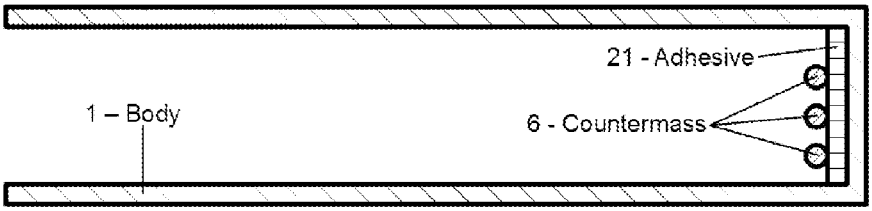
FIG. 16 is a partial cutaway view of an embodiment of the apparatus of the present invention showing an alternate configuration.

FIG. 16 shows an embodiment of the recoil controller similar to the embodiment shown in FIG. 1, except that the process of recapturing the force carried by the countermass is enhanced by means of another property of its inner surfaces: stickiness. The rearward surface is coated with an adhesive that causes the countermass to be temporarily or permanently captured upon contact. The figure is not drawn to scale. The embodiment of FIG. 16 should not be construed as a limitation on the scope of the configurations which allow the recoil controller to function by means of properties of the inner surfaces other than their geometry. Many other variations are possible. I presently contemplate that a recoil controller exhibiting any configuration such that properties of the inner surfaces other than their geometry are instrumental in the recapturing of at least some of the force that is being used to control recoil, such that the post-transfer distributions over time of the momenta of the members involved in the process are different from the pre-transfer distributions over time of the momenta of the members involved in the process, comprises an embodiment of the recoil controller.

The embodiment shown in FIG. 16 operates in essentially the same fashion as the embodiment shown in FIG. 1 except for the presence of inner surfaces configured such that properties other than their geometry play a significant role in its operation.

Figure 17:
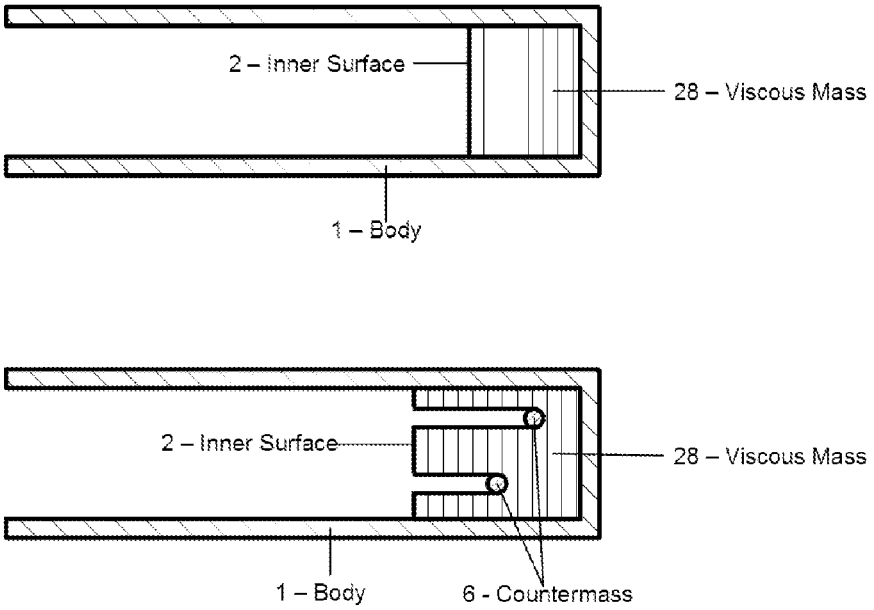
FIG. 17 is a partial cutaway view of an embodiment of the apparatus of the present invention showing an alternate configuration.

FIG. 17 shows an embodiment of the recoil controller similar to the embodiment shown in FIG. 1, except that the geometry of the inner surface 2 is different, and the inner surface 2 is composed of a viscous mass 28 into which the countermass 6 can become lodged. Momentum is transferred to the recoil controller through the viscous mass 28 as the countermass 6 decelerates while traveling through the viscous mass 28. Further momentum may be transferred to the recoil controller if or when the countermass 6 impacts against another member of which the recoil controller is comprised. FIG. 17 shows the embodiment of the recoil controller both before and after use.

Figure 18:
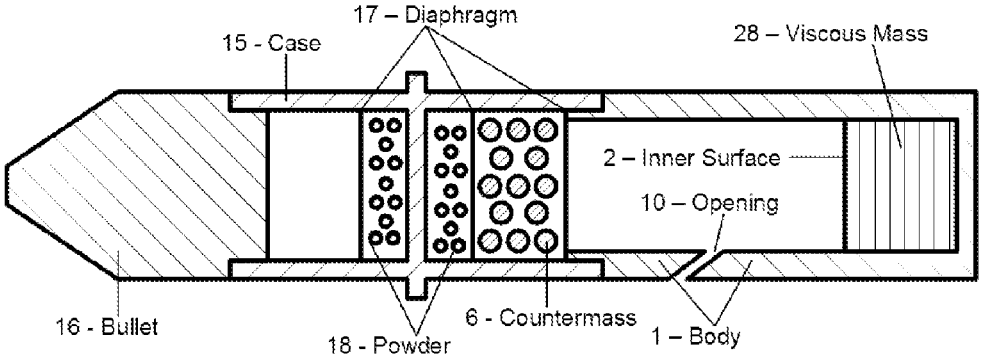
FIG. 18 is a partial cutaway view of an embodiment of the apparatus of the present invention configured as a separate unit attached to the case of a projectile to be fired by a projectile launcher.

The embodiment of FIG. 17 should not be construed as a limitation on the scope of the configurations by which the recoil controller can comprise an inner surface into which the countermass can become lodged. The term "viscous" is intended to be interpreted relative to the environment (most likely air) through which the countermass travels as it passes through the cavity of the recoil controller. In this context, even a mass composed of such low-viscosity substances as Styrofoam may be referred to as a "viscous mass". Many other configurations are possible including, but not limited to, configurations comprising a viscous mass that is not homogenous, configurations comprising a viscous mass in which the countermass only remains lodged temporarily, and configurations comprising any mass of high, medium or low viscosity into which the countermass can become lodged, such as resins, waxes, gums, or even such low-viscosity substances as Styrofoam. I presently contemplate that a recoil controller exhibiting any configuration that comprises at least one surface into which the countermass can become temporarily or permanently lodged, such that the post-transfer distributions over time of the momenta of the members involved in the process are different from the pre-transfer distributions over time of the momenta of the members involved in the process, comprises an embodiment of the recoil controller. FIG. 18 shows the same technology, with the addition of an opening 10 for the escape of expanding gasses, connected directly to a projectile to be launched by a projectile launcher. It should be noted that while both the bullet and the body of the recoil controller of FIG. 18 are connected to the case via friction, in this embodiment only the bullet is meant to detach from the case during the course of normal use.

The embodiments shown in FIGS. 17 and 18 operate in essentially the same fashion as the embodiment shown in FIG. 1 except for the presence of a surface into which the countermass can become lodged and an opening for the escape of expanding gasses.

The following is a list of parts and materials suitable for use in the present invention:

PARTS LIST:

| PART NUMBER | DESCRIPTION |
|---|---|
| 1 | body |
| 2 | inner surface |
| 3 | open end |
| 4 | closed end |
| 5 | cavity |
| 6 | countermass |
| 7 | point of impact |
| 8 | arrow |
| 9 | arrow |
| 10 | opening |
| 11 | channel |
| 12 | lining |
| 13 | membrane |
| 14 | barrel |
| 15 | case |
| 16 | bullet |
| 17 | diaphragm |
| 18 | powder |
| 19 | baffle |
| 20 | recess |
| 21 | adhesive |
| 22 | movable mount |
| 23 | handle |
| 24 | shock-wave |
| 25 | vessel |
| 26 | cap |
| 27 | spring |
| 28 | viscous mass |

The foregoing embodiments are presented by way of example only; the scope of the present invention is to be limited only by the following claims.

The invention claimed is:

1. A recoil control device comprising:

a body having a cavity that is positioned to receive a countermass upon launching of a projectile, said countermass traveling in a predetermined direction relative to said projectile, said cavity defined by an inner surface having a first portion and a second portion, the first portion of said inner surface being at a first angle that is neither perpendicular nor parallel to said predetermined direction, whereby said countermass strikes said inner surface more than once and at different times so that a resulting rate of recoil transfer from the countermass to the body is not immediate but occurs over a period of time.

2. The recoil control device according to claim 1 wherein the first portion of said inner surface angles inwardly toward said predetermined path from a position more proximal to a location where said countermass enters said cavity toward a position more remote from the location where said countermass enters said cavity whereby said countermass impacts said first portion of the inner surface after entering said cavity.

3. The recoil control device according to claim 1 wherein said body is attached to a projectile casing.

4. The recoil control device according to claim 1 wherein said body is attached to a projectile.

5. The recoil control device according to claim 1 wherein said body is attached to a projectile launcher.

6. The recoil control device according to claim 1 wherein said body has at least one opening that allows material and expanding gases to exit said cavity.

7. The recoil control device according to claim 1 further comprising a membrane within said cavity through which said countermass passes to transfer momentum from said countermass to said body.

8. The recoil control device according to claim 6 further comprising a baffle adjacent to said opening for deflecting matter exiting said opening away from a user.

9. The recoil control device according to claim 1 wherein either of said countermass and the inner surface of said body is subjected to a magnetic field for causing said inner surface and said countermass to magnetically interact.

10. The recoil control device according to claim 1 wherein either of said countermass and the inner surface of said body is subjected to an electrical charge for causing said inner surface and said countermass to interact.

11. The recoil control device according to claim 1 wherein either of said countermass and the inner surface of said body includes an adhesive for causing said countermass to adhere to said inner surface.

12. The recoil control device according to claim 1 wherein the inner surface further includes at least one recess for capturing said countermass.

13. The recoil control device according to claim 1 further comprising a viscous material positioned on said inner surface.

14. The recoil control device according to claim 1 wherein the first portion of the inner surface is movable.

15. The recoil control device according to claim 14 wherein the first portion is movable by a biasing mechanism.

16. The recoil control device according to claim 14 wherein the first portion is manually movable.

17. The recoil control device according to claim 14 wherein the first portion is automatically movable by an auxiliary device.

18. The recoil control device according to claim 1 wherein said countermass is a gas.

19. The recoil control device according to claim 1 wherein said countermass is a shock wave traveling through a medium.

20. The control device according to claim 1 further comprising a lining on the inner surface of said body.

21. The control device according to claim 20 wherein said lining has discrete physical characteristics relative to the inner surface of said body.

22. The control device according to claim 6 further comprising a vessel attachable to said body adjacent to said opening for receiving material ejected therefrom.

23. The control device according to claim 1 wherein said projectile is launched from a projectile launcher.

24. A recoil control device comprising:

a body having a cavity that is positioned to receive a countermass upon launching of a projectile, said countermass traveling in a predetermined direction relative to said projectile, said cavity defined by an inner surface having a first portion and a second portion, the first portion of said inner surface having either of an adhesive and a viscous material positioned thereon for capturing said countermass.

25. A method of controlling recoil comprising the steps of:

positioning a body cavity to receive a countermass upon launching of a projectile, wherein said countermass travels in a predetermined direction relative to said projectile;

configuring the cavity to include an inner surface having a first portion and a second portion;

positioning the first portion of the inner surface at a first angle that is neither perpendicular nor parallel to said predetermined direction, whereby said countermass strikes said inner surface more than once and at different times so that a resulting rate of recoil transfer from the countermass to the body is not immediate but occurs over a period of time.

26. The method of controlling recoil according to claim 25 further comprising the steps of attaching the body to a projectile casing.

27. The method of controlling recoil according to claim 25 further comprising the steps of attaching said body to the projectile.

28. The method of controlling recoil according to claim 25 further comprising the steps of attaching said body to a projectile launcher.

29. The method of controlling recoil according to claim 25 further comprising the steps of forming at least one opening on said body to allow material and expanding gases to exit said cavity.

30. The method of controlling recoil according to claim 25 further comprising the steps of positioning a membrane within said cavity through which said countermass passes to transfer momentum from said countermass to said body.

31. The method of controlling recoil according to claim 25 further comprising the steps of positioning a baffle adjacent to said opening for deflecting matter exiting said opening away from a user.

32. The method of controlling recoil according to claim 25 further comprising the steps of subjecting either of said countermass and the inner surface of said body to a magnetic field for causing said inner surface and said countermass to magnetically interact.

33. The method of controlling recoil according to claim 25 further comprising the steps of subjecting either of said countermass and the inner surface of said body to an electrical charge for causing said inner surface and said countermass to interact.

34. The method of controlling recoil according to claim 25 further comprising the steps of placing an adhesive on either of said countermass and the inner surface of said body for causing said countermass to adhere to said inner surface.

35. The method of controlling recoil according to claim 25 further comprising the steps of forming a recess on the inner surface for capturing said countermass.

36. The method of controlling recoil according to claim 25 further comprising the steps of positioning a viscous material on said inner surface.

37. The method of controlling recoil according to claim 25 further comprising the steps of making the first portion of the inner surface movable.

38. The method of controlling recoil according to claim 25 further comprising the steps of moving the first portion with a biasing mechanism.

39. The method of controlling recoil according to claim 25 further comprising the steps of manually moving the first portion.

40. The method of controlling recoil according to claim 25 further comprising the steps of automatically moving the first portion with an auxiliary device.

41. The method of controlling recoil according to claim 25 wherein said countermass is a gas.

42. The method of controlling recoil according to claim 25 wherein said countermass is a shock wave traveling through a medium.

43. The method of controlling recoil according to claim 25 further comprising the steps of placing a lining on the inner surface of said body.

44. The method of controlling recoil according to claim 25 further comprising the steps of placing a lining having discrete physical characteristics on the inner surface of said body.

45. The method of controlling recoil according to claim 29 further comprising the steps of attaching a vessel to said body adjacent to said opening for receiving material ejected therefrom.

46. The method of controlling recoil according to claim 22 further comprising the steps of launching said projectile from a projectile launcher.

* * * * *